US005685275A

United States Patent [19]

Djordjevic

[11] Patent Number: 5,685,275

[45] Date of Patent: Nov. 11, 1997

[54] FUEL INJECTION PUMP WITH SPILL AND LINE PRESSURE REGULATING SYSTEMS

[75] Inventor: Ilija Djordjevic, East Granby, Conn.

[73] Assignee: Stanadyne Automotive Corp., Windsor, Conn.

[21] Appl. No.: 640,239

[22] Filed: Apr. 30, 1996

[51] Int. Cl.[6] ..... F02M 41/00

[52] U.S. Cl. ..... 123/467; 125/450

[58] Field of Search ..... 123/450, 467, 123/506; 417/462

[56] References Cited

U.S. PATENT DOCUMENTS

| | | | |
|---|---|---|---|
| 3,319,616 | 5/1967 | Glikin | 123/450 |
| 4,232,644 | 11/1980 | Potter | 123/450 |
| 4,246,876 | 1/1981 | Bouwkamp | 123/467 |
| 4,336,981 | 6/1982 | Overfield | 123/467 |
| 4,446,835 | 5/1984 | Mowbray | 123/450 |
| 4,453,896 | 6/1984 | Villardo | 123/450 |
| 4,499,884 | 2/1985 | Skinner | 123/467 |
| 4,896,645 | 1/1990 | Potter | 123/506 |
| 4,920,940 | 5/1990 | Harris | 123/450 |
| 5,012,785 | 5/1991 | Long | 123/450 |
| 5,413,081 | 5/1995 | Colliweborn | 123/450 |

*Primary Examiner*—Carl S. Miller
*Attorney, Agent, or Firm*—Alix, Yale & Ristas, LLP

[57] ABSTRACT

A fuel injection pump having a pump rotor with a pump body and distributor rotor in coaxial alignment, the pump body having a pumping chamber with one or more diametral pumping plunger bores with opposed pumping plungers; a cam ring surrounding the pump body for reciprocating the pumping plungers for supplying intake charges of fuel to the pumping chamber and delivering high pressure charges of fuel for fuel injection; a spill valve having a coaxial valve bore in the pump body intersecting the diametral pumping plunger bore(s), a spill valve member having a pair of diametrically opposed spill ports with transverse leading edges, a self-centering actuator shoe mounted within a diametral slot in the spill valve member for engagement by radial actuating rods for translating inward radial movement of the actuating rods into axial movement of the spill valve member to its open position for spill termination of each fuel injection event in fixed synchronism with the pumping plungers; and a transverse connector bore in the distributor rotor with an inlet port trailing a distributor port for returning fuel from each active fuel line to an inactive fuel line immediately after spill termination of the fuel injection event.

18 Claims, 4 Drawing Sheets

10
12
13
14
16
18
20
22
24
25
28
29
30
31
33
35
37
38
39
40
42
50
51
54
55
56
58
62
64
66
68
70
72
76
78
8
210

FUEL INJECTION PUMP WITH SPILL AND LINE PRESSURE REGULATING SYSTEMS

BACKGROUND AND SUMMARY OF INVENTION

The present invention generally relates to fuel injection pumps of the type having an outer cam ring and inner pump body in coaxial relationship; the pump body having one or more diametral pumping plunger bores forming a pumping chamber; and a pair of opposed pumping plungers in each diametral pumping plunger bore; the cam ring and pump body being relatively rotatable for periodically actuating the pumping plungers inwardly with the cam ring for delivering high pressure charges of fuel from the pumping chamber to the fuel injection nozzles of an internal combustion engine. (A fuel injection pump of the type described above is hereafter referred to as "Fuel Injection Pump Of The Type Described".)

More particularly, the present invention relates to a Fuel Injection Pump Of The Type Described (a) having a new and improved spill system for spill termination of the high pressure charges of fuel before the end of the inward pumping strokes of the pumping plungers and/or (b) having a rotary distributor for distributing the high pressure charges of fuel from the pumping chamber to the fuel injection nozzles in succession (hereafter referred to as "Rotary Distributor Type Fuel Injection Pump") and a new and improved line pressure regulating system for (1) pre-injection regulation of the line pressure in each nozzle fuel line for receiving a high pressure charge of fuel and/or for (2) post-injection regulation of the line pressure in the active fuel line for preventing secondary fuel injection and excess return of fuel from the active fuel line to the fuel injection pump.

In some Fuel Injection Pumps Of The Type Described of conventional design, the pumping chamber remains at a high delivery pressure until the end of the inward pumping strokes of the plungers. As a result, a large reaction force, caused primarily by the high delivery pressure, is applied to the rounded convex ends of the cam lobes of the cam ring. Because of the resulting high stress, the fuel injection system is usually designed to provide a maximum delivery pressure significantly less than the desired or optimum pressure.

A principal object of the present invention is to provide in a Fuel Injection Pump Of The Type Described, a new and improved spill system which automatically spills fuel from the pumping chamber before the end of the inward pumping strokes of the pumping plungers so as to significantly reduce the reaction force on the rounded convex ends of the cam lobes.

Another object of the present invention is to provide in a Fuel Injection Pump Of The Type Described, a new and improved spill system for automatic, timely and consistent spill termination of each fuel injection event.

Another object of the present invention is to provide in a Fuel Injection Pump Of The Type Described, a new and improved spill system for (a) reducing the duration of each fuel injection event, (b) reducing engine emissions (e.g., smoke), (c) increasing combustion efficiency and engine horsepower and (d) reducing fuel consumption.

Another object of the present invention is to provide in a Fuel Injection Pump Of The Type Described, a new and improved spill system which provides optimum rate shaping at the end of each fuel injection event.

Another object of the present invention is to provide in a Rotary Distributor Type Fuel Injection Pump, a new and improved line pressure regulating system for pre-conditioning each fuel line for receiving a high pressure charge of fuel. Included in this object is the provision of a line pressure regulating system which returns a large part of the otherwise spilled fuel from the active fuel line to an inactive fuel line to assist in preconditioning the inactive fuel lines in succession for receiving the high pressure charges of fuel.

A further object of the present invention is to provide in a Rotary Distributor Type Fuel Injection Pump, a new and improved line pressure regulating system which reduces the volume of fuel returned from the active fuel line to the pumping chamber.

A further object of the present invention is to provide in a Rotary Distributor Type Fuel Injection Pump, a new and improved line pressure regulating system for dampening reflected pressure waves from the active fuel injection nozzle for preventing secondary fuel injection.

A further object of the present invention is to provide in a Rotary Distributor Type Fuel Injection Pump, a new and improved line pressure regulating system which regulates the fuel return from each active fuel line after the fuel injection event and which is separate from and does not affect the high pressure delivery of fuel to the fuel injection nozzles.

A still further object of the present invention is to provide in a Rotary Distributor Type Fuel Injection Pump, a new and improved spill system and/or line pressure regulating system having one or more of the above described functions and benefits, which is of simple construction, which can be readily embodied in Rotary Distributor Type Fuel Injection Pumps of conventional design, which will not adversely affect the normal operation of the pump, and which will operate consistently and reliably over a long service free life.

Other objects in part will be obvious from the following description and in part will be pointed out in more detail hereinafter.

A better understanding of the present invention will be obtained from the following description and accompanying drawings.

DESCRIPTION OF PREFERRED EMBODIMENTS

Figure 1:
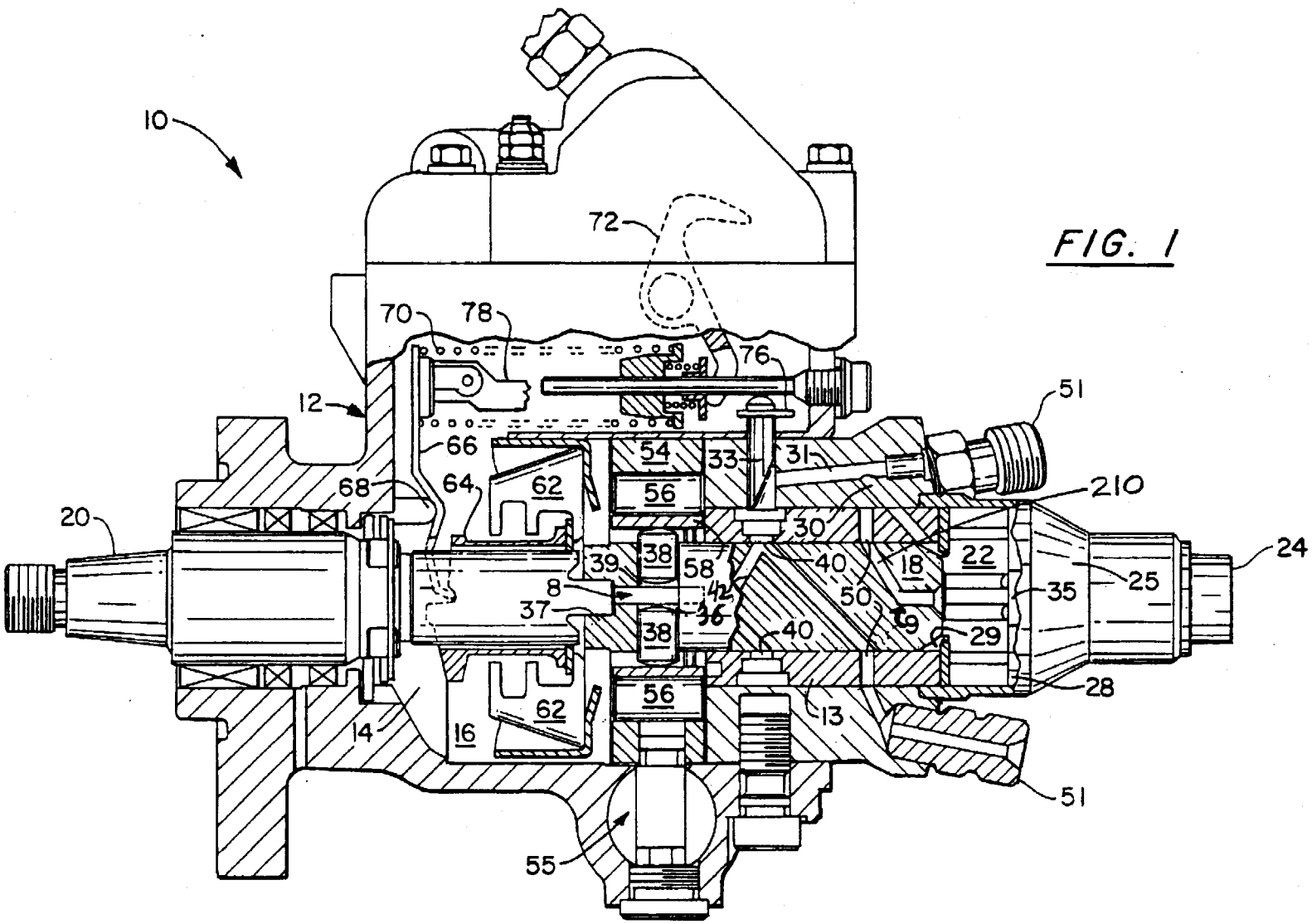
FIG. 1 is a longitudinal section view, partly broken away and partly in section, of a fuel injection pump having spill and line pressure regulating systems incorporating an embodiment of the present invention.

In the drawings, the same numerals are used to represent the same or similar parts.

Figure 2:
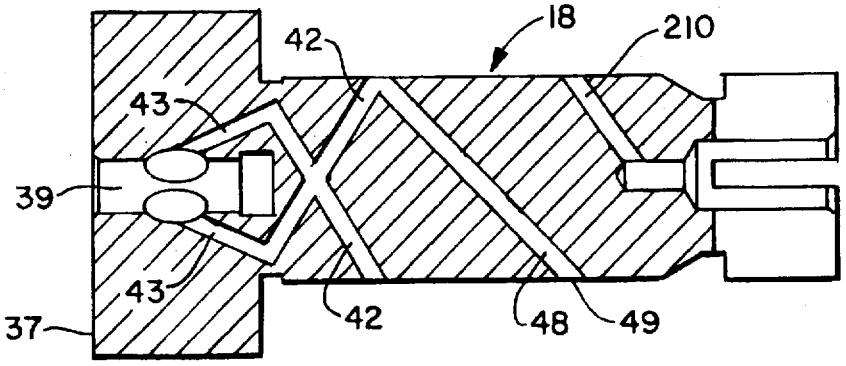
FIG. 2 is a longitudinal section view of the rotor portion of the pump shown in FIG. 1.

FIGS. 1 and 2 show a fuel injection pump 10 having a spill system 8 and line pressure regulating system 9 incorporating an embodiment of the present invention. The pump 10 has a housing 12 with a housing cavity 14 providing a governor chamber 16. A rotor 18 and rotor drive shaft 20 are coaxially mounted in the housing 12. The rotor 18 is surrounded by a coaxial sleeve member 13. The pump 10 is adapted to be mounted on an internal combustion engine (not shown) for rotating the pump drive shaft 20 with the engine, normally at one-half engine speed.

A vane-type transfer pump 22 is provided at the outer end of the rotor 18. Fuel is supplied from a fuel tank (not shown) via a housing inlet 24 and a screen filter within region 25 to a transfer pump inlet 28. A transfer pump outlet annulus 29 (FIG. 1) is connected via passages 30 and 31 in the head 53 and sleeve 13 to a rotary inlet metering valve 33. A transfer pump regulator 35 regulates the outlet pressure of the transfer pump 22 by returning excess fuel to the transfer pump inlet 28. The regulator 35 regulates the outlet pressure so that it increases with pump speed (e.g., increases from 40 psi at idle speed to 110 psi at maximum speed) to meet the engine requirements and to provide a speed related pressure for performing certain control functions of the pump 10.

The pump rotor 18 provides a pump body 37 having one or more diametral bores 36, each receiving a pair of opposed pumping plungers 38. A pumping chamber 39 formed by the diametral bore(s) 36 receives fuel via the inlet metering valve 33, a plurality of radial inlet ports 40 (two of which are shown in FIG. 1), a pair of diagonal inlet passages 42 in the rotor 18 and a pair of diametrically opposed, V-shaped passages 43 connecting the inlet passages 42 to the pumping chamber 39. Fuel is delivered from the pumping chamber 39 at high pressure via the V-shaped passages 43, one of the diagonal inlet passages 42, a diagonal distributor bore 48 and a distributor port 49 to a plurality of distributor outlet ports 50 in the sleeve 13 (only one of which is shown in FIG. 1). The outlet ports 50 are connected to the fuel injection nozzles (not shown) of the engine via fittings 51 angularly spaced around a hydraulic head 53 and respective fuel lines (not shown) connecting the fittings 51 to the nozzles.

The pump body 37 is surrounded by a coaxial cam ring 54. Rotation of the pump rotor 18 provides relative rotation of the central pump body 37 and outer cam ring 54. The cam ring 54 has an internal cam surface with a plurality of angularly spaced cam lobes for periodically actuating the plungers 38 inwardly together for delivering fuel from the pumping chamber 39 at high pressure. The cam ring 54 is angularly adjusted by a timing piston 55 for varying the delivery timing of the high pressure charges of fuel. A roller assembly 56 is mounted between each plunger 38 and the cam ring 54. Each roller assembly 56 comprises a cam follower or roller engageable with the cam ring 54 and a roller support shoe 58 mounted within an axial slot in the pump body 37 and having an inner, flat end face engageable with the outer flat end face of the respective plunger 38.

The inlet ports 40 are angularly spaced around the rotor 18 in a common transverse plane for registration with the diagonal inlet passages 42 during the outward intake strokes of the plungers 38. Similarly, the distributor outlet ports 50 are angularly spaced around the rotor 18 in a common transverse plane for sequential registration with the distributor port 49 during the inward pumping strokes of the plungers 38.

A plurality of governor weights 62, angularly spaced around the drive shaft 20, bias, via a sleeve 64, a governor plate 66 in one pivotal direction about a support pivot 68. The governor plate 66 is urged in the opposite pivotal direction by a governor spring assembly 70, the bias of which is established by a throttle operated cam 72. The governor plate 66 is connected to angularly position the inlet metering valve 33 by an arm 76 fixed to the metering valve 33 and a link and spring mechanism 78 (only partly shown) interconnecting the governor plate 66 and arm 76.

A metered quantity of fuel is supplied to the pumping chamber 39 during the outward intake strokes of the plungers 38. The fuel quantity is regulated by the rotary valve 33 by varying the valve restriction to the passage of fuel from the transfer pump 22 to the pumping chamber 39. The governor rotates the valve 33 in a closing direction to increase the fuel restriction if the pump speed increases above an equilibrium speed established by the opposing forces of the governor weights 62 and governor spring assembly 70. The governor rotates the valve 33 in an opening direction to reduce the fuel restriction if the speed falls below the equilibrium speed.

The spill system or mechanism 8 connects the pumping chamber 39 to the housing cavity 14 at a fixed predetermined point during the inward pumping strokes of the pumping plungers 38 to spill terminate each fuel injection event. Spill termination preferably is completed or at least begun before the cam followers 56 engage the rounded convex ends of the cam lobes. Accordingly, the rounded convex ends are engaged by the rollers 56 after the pumping chamber pressure is partly or fully relieved and therefore with a significantly lower reaction force.

Figure 3:
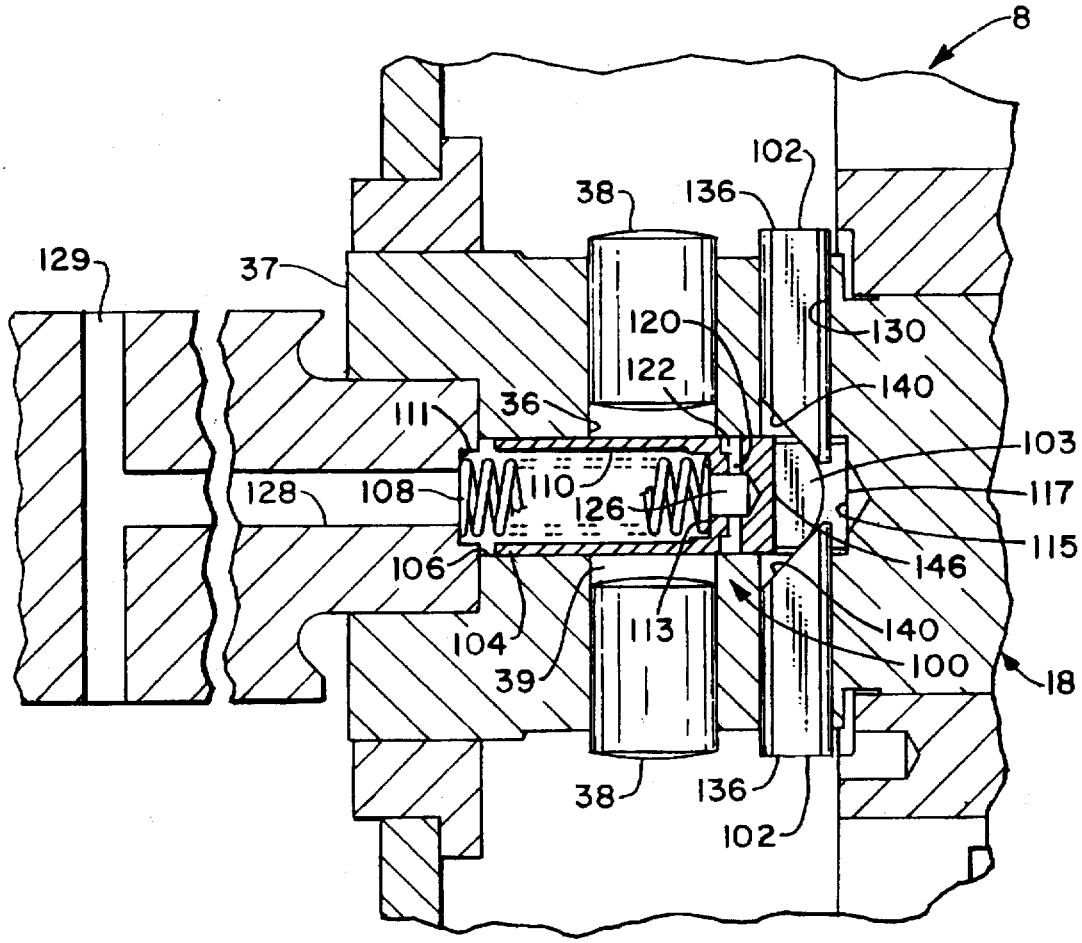
FIG. 3 is an enlarged, partial longitudinal section view, partly broken away and partly in section, of the fuel injection pump, showing the spill system in greater detail.
Figure 4:
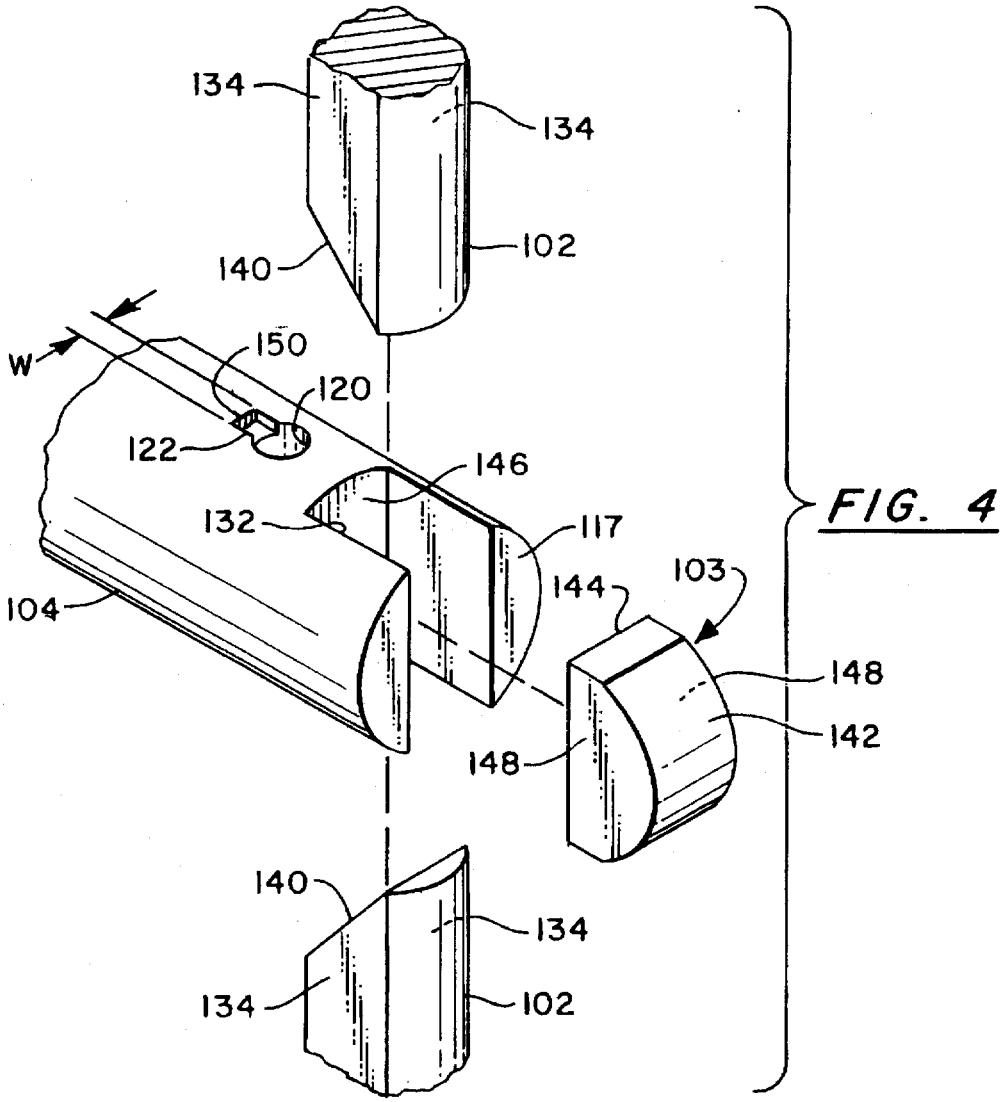
FIG. 4 is an exploded view in perspective of the front portion of the valve member and associated actuating structure shown in FIG. 3.

FIGS. 3 and 4 show the spill mechanism 8 of the present invention, comprising a spill valve 100, a pair of radially extending and diametrically opposed, valve actuator rods 102 and an intermediate cam shoe 103. The spill valve 100 has a spool type valve member 104 mounted within a coaxial bore 106 in the body 37 of rotor 18 which intersects the diametral bore(s) 36. The valve member 104 is biased in the outward axial direction (to the right as shown in FIGS. 1–3), to a closed position shown in FIG. 3, by a compression spring 108. The compression spring 108, which serves as a valve closure spring, is mounted within a coaxial bore 110 in the valve member 104 between a closed inner end face 111 of the drive shaft 20 and an opposing inner end face 113 of the spring chamber bore 110. The coil spring 108 preferably has two or three dead coils at each end to reduce the possibility of a short end portion of spring breaking off and lodging between the valve member 104 and drive shaft 20 and then blocking the valve member 104 against inward opening movement.

A transverse (diametral) spill bore 120 is provided in the valve member 104. A pair of diametrically opposed spill ports 122 are provided or a peripheral spill annulus 124 (FIG. 5) is provided at the outer ends of the spill bore 120. The spill bore 120 is connected via a short coaxial bore 126 in the valve member 104 to the spring chamber bore 110 and then via coaxial and diametral bores 128, 129 in the drive shaft 20 to the housing cavity 14. As hereinafter described, the valve member 104 is actuated against the closure spring 108 to shift the spill ports 122 (or spill annulus 124) into communication with the pumping chamber 39 to spill terminate the fuel injection event.

The two actuator rods 102 are mounted within a diametral bore 130 in the pump body 37. The diametral bore 130 intersects the outer end 115 of the valve bore 106 and is adjacent to and in angular alignment with a pumping plunger bore 36. A transverse (diametral) slot 132 is provided in the outer end of the valve member 104 (parallel to the diametral spill bore 120) for receiving the inner ends of the actuator rods 102. The actuator rods 102 have flat parallel sides 134 engageable with the opposing, flat parallel sides of the slot 132 to permit the rods 102 to slide freely within the slot 132 and yet to prevent rotation of the actuator rods 102 and valve member 104 within their respective mounting bores 130, 106. The actuator rods 102 have outer, flat, transverse end faces 136 for face-to-face engagement with the inner flat end faces of the roller shoes 58 for the adjacent plungers 38.

Each actuator rod 102 has an inner, flat end face 140 for face-to-face engagement with an opposing oblique preferably arcuate surface 142 on the outer end of central cam shoe 103. Each pair of opposing faces or surfaces 140, 142 are inclined to the axis of the actuator rods 102 and to the axis of the valve member 104, preferably at an angle of 45°, to translate the radially inward movement of the rods 102 into axially inward movement of the cam shoe 103 and valve member 104. The central cam shoe 103 serves as a radially floating or self-centering valve actuator between the actuator rods 102. The cam shoe 103 is received within the valve member slot 132 with its inner, flat end face 144 in face-to-face engagement with an opposing, diametral, flat face 146 of the valve member 104 at the inner end of the valve member slot 132. Also, the cam shoe 103 has flat parallel sides 148 engaging the opposing flat sides of the slot 132 to retain the cam shoe against rotation within the slot 132 while permitting the cam shoe 103 to slide freely within the slot 132.

When the roller shoes 58 are at their outermost positions (in engagement with adjustable, leaf spring stops, not shown), (a) the outer end 117 of valve member 104 is urged against the outer end face 115 of its blind mounting bore 106 by the valve closure spring 108, and (b) the cam shoe 103 and actuator rods 102 have limited radial play between the respective two roller shoes 58 (e.g., permitting 0.020 inch radial movement of the cam shoe 103 and actuator rods 102). This play is facilitated by assuring that the axial length of slot 132 is greater than the axial length of the cam shoe 103. The end face 115 of the bore 106 is located axially outward of the wall of diametrical bore 130. Because the outer end 117 of the valve is urged against end face 115, the valve 104 and actuator rods 102 are restrained from vibrating as a consequence of dynamic forces arising during the pumping cycle, prior to spill initiation. This damping effect contributes further to the advantage of achieving precise spill timing, by maintaining a consistent distance between the edge 150 of spill port 122 and the wall of the pumping chamber 36.

When the roller assemblies 56 are actuated inwardly by the cam ring 54, the radial play is removed by the initial inward movement of the roller shoes 58. During the following inward movement of the roller shoes 58 and accompanying inward displacement of the valve member 104, the actuator rods 102 remain in engagement with the cam shoe 103 and roller shoes 58. The central cam shoe 103 slides radially within the valve member slot 132 as necessary to maintain such engagement. Because of the radial self-centering function of the central cam shoe 103, during the inward pumping strokes of the plungers 38, the simultaneous radial movement of the actuator rods 102 is coordinated to provide balanced forces on the cam shoe 103 and therefor smooth and consistent inward displacement of the valve member 104. That is so notwithstanding any eccentricity (e.g., up to 0.020 inch or more) between the axes of the cam ring 54 and rotor 18 and the resulting variation in the inward stroke timing of the opposed roller shoes 58. Accordingly, the valve member 104 is actuated to shift the spill ports 122 (or spill annulus 124) into communication with the pumping chamber 39 at the same point during each fuel injection cycle. Such communication begins before the rollers 56 engage the rounded convex ends of the cam lobes or cam ring 54 so that the valve member 104 is rapidly actuated, at least initially, by the steepest part of the cam surface of the cam ring 54. Also, the valve member 104 spill terminates the fuel injection event so that the spill termination is completed or at least begun before the rollers 56 engage the convex outer ends of the cam lobes.

The particular cam shoe 103 actually installed for operation in a particular pump is preferably selected emperically to accommodate all the tolerances of the other pump-related components. For example, a first cam shoe 103 having a known first axial length is installed. The spill timing is then observed. Through trial and error, or from a look-up table, a second cam shoe having a known second axial length is substituted. In this manner, the spill timing can be adjusted to optimize initiation of spill relative to the approach of the roller 56 to the inflection of the nose profile or cam ring 54.

Figure 5:
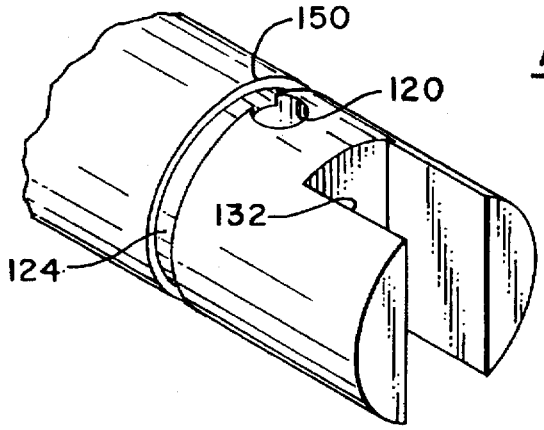
FIG. 5 is a perspective view of the front portion of a modified valve member of the spill system.

Referring to FIG. 4, the two spill ports 122 are preferably formed with straight, transverse, leading edges 150 (i.e., lying in a transverse plane perpendicular to the valve axis). Each leading edge 150 has an angular width W which may be equal to or greater or less than the diameter of the spill bore 120. As shown in FIG. 5, a single peripheral spill annulus 124 may be provided in place of the two spill ports 122. The leading edge width of the two spill ports 122 (or spill annulus 124) affects the spill rate as the spill ports 122 (or spill annulus 124) move into communication with the pumping chamber 39. The leading edge width W is determined for each pump application to provide the optimum spill rate (and therefore the optimum rate shaping at the end of injection). A valve member 104 having the desired spill port configuration is installed, and can be easily replaced if desired, to establish the optimum spill rate.

Figure 6:
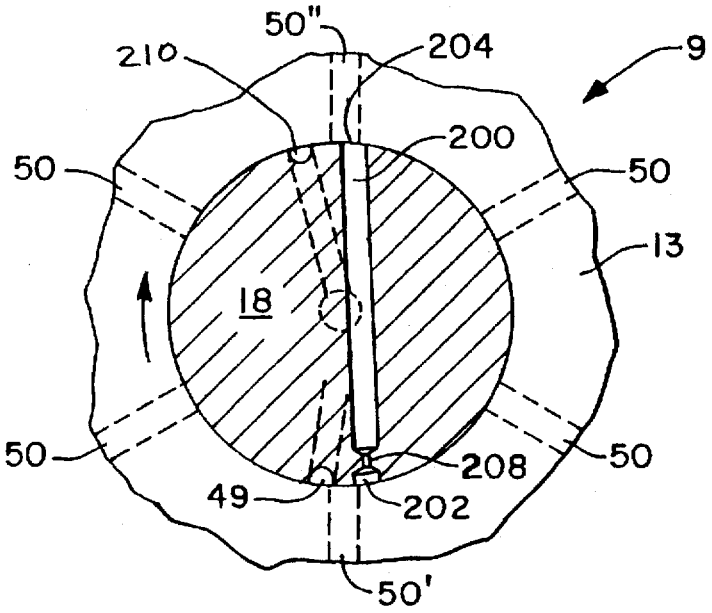
FIGS. 6 and 7 are section views of the fuel injection pump body, showing the line pressure regulating system in greater detail.
Figure 7:
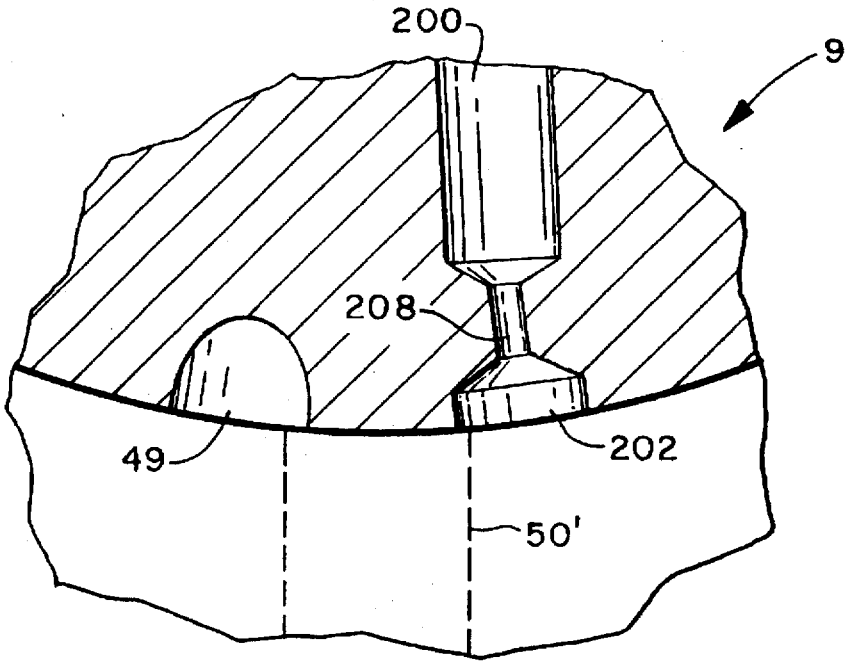

The line pressure regulating system 9 is shown in detail in FIGS. 6 and 7. A transverse connector passage or bore 200 is provided in the rotor 18 in the transverse plane of the distributor outlet ports 50. A straight, approximately diametral (but radially offset) connector bore 200 is shown. The connector bore 200 is located so that a connector inlet port 202 rotates into registry with the active distributor outlet port 50' immediately after spill termination of the fuel injection event and just a few degrees before the distributor port 49 moves out of registry with the active outlet port 50'. The connector inlet port 202 trails the distributor port 49 by a few degrees to provide the desired timing. A connector outlet port 204 registers with one of the inactive distributor outlet ports 50" when the connector inlet port 202 rotates into registry with the active outlet port 50. Accordingly, the active fuel line is temporarily connected, by the transverse connector bore 200 during a few degrees of rotation of the rotor 18, to an inactive fuel line immediately after spill termination of the fuel injection event. As used herein, "register" means sufficient overlap to permit fluid flow.

A snubber orifice 208 is provided in the connector bore 200, preferably adjacent the connector inlet port 202, to dampen reflected pressure waves from the active fuel line. The snubber orifice 208 is sized to prevent secondary fuel injection and excess return of fuel from the active fuel line to the inactive fuel line (and thus to reduce partial evacuation of the active line). In the foregoing manner, excess fuel from the active fuel line is conducted directly to an inactive fuel line to assist in conditioning the inactive line for receiving a high pressure charge of fuel. Also, post-injection regulation of the line pressure in the active fuel line is achieved in a manner completely separate and independent from the high pressure delivery of fuel to the active fuel line and nozzle.

A second or trailing line preconditioning port 210 is provided on the rotor 18 for registry with each distributor outlet port 50 after the connector outlet port 204 moves out of registry with the distributor outlet port 50. The trailing port 210 is connected to the transfer pump outlet 29 and registers with the distributor outlet port 50 to preset the downstream line pressure at approximately the transfer pump outlet pressure. In that manner, each inactive fuel line is preconditioned before each fuel injection event so that the quantity of injected fuel does not vary from nozzle to nozzle due to variations in the incipient line pressure.

A significant advantage of this aspect of the invention, becomes most evident in the event of a broken nozzle spring or nozzle needle stuck in the open position. The cylinder of the inactive port 50" is in the exhaust phase, so that the fuel discharged in an uncontrolled manner through the defective nozzle leaves the engine cylinder together with the exhaust gases, thereby inhibiting structural damage to the engine.

As will be apparent to persons skilled in the art, various modifications, adaptations and variations of the foregoing specific disclosure can be made without departing from the teachings of the present invention.

I claim:

1. In a rotary fuel injection pump having an outer cam ring and inner pump body in coaxial relationship; the pump body having a pumping chamber with at least one diametral pumping plunger bore; a pair of opposed pumping plungers in each diametral pumping plunger bore; the cam ring and pump body being relatively rotatable for periodically actuating the pumping plungers inwardly with the cam ring for delivering high pressure charges of fuel from the pumping chamber for fuel injection; and a spill mechanism for spilling fuel from the pumping chamber for spill termination of the delivery of the high pressure charges of fuel; the spill mechanism comprising a spill valve having a coaxial valve bore in the pump body in communication with the pumping chamber and a spill valve member axially shiftable in the valve bore in one axial direction to a closed position thereof and in the opposite axial direction to an open position thereof for spilling fuel from the pumping chamber, means biasing the valve member in said one direction to its closed position and a valve actuating mechanism comprising a diametral actuator rod bore in the pump body and a pair of radial actuator rods mounted in the actuator rod bore for inward radial actuation by the cam ring in synchronism with the inward actuation of the pumping plungers for actuating the valve member in said opposite axial direction to its open position; the improvement wherein the spill valve member has a diametral slot therein with opposed parallel side faces and a flat, diametral end face and wherein the valve actuating mechanism further comprises a self-centering actuator shoe mounted within the diametral slot in operative engagement with said end face, for diametral movement within the diametral slot and for operative engagement by the actuator rods for translating inward radial movement of the actuator rods into axial movement of the valve member in said opposite direction.

2. A fuel injection pump according to claim 1 wherein the spill valve member has at least one peripheral spill port with a leading spill edge in a transverse plane perpendicular to the axis of the valve member and wherein the spill port moves into communication with the pumping chamber as the spill valve is actuated in said opposite axial direction from its closed position to its open position.

3. A fuel injection pump according to claim 1 wherein the actuator shoe and each actuator rod have cooperating cam surfaces for translating inward radial movement of the actuator rods into axial movement of the valve member in said opposite direction.

4. A fuel injection pump according to claim 3 wherein the cooperating surfaces lie in planes extending at an angle of approximately 45° to the axes of the valve member and actuator rods.

5. A fuel injection pump according to claim 2 wherein the spill valve member is a spool valve and has at least two of said peripheral spill ports.

6. A fuel injection pump according to claim 5 wherein the spill valve member has a diametral spill bore and wherein the two peripheral spill ports are located at the outer ends of the diametral spill bore.

7. A fuel injection pump according to claim 1 wherein the actuator shoe and the inner ends of the actuator rods have outer parallel side faces engageable with the opposed parallel side faces of the valve member slot to retain the actuator shoe and actuator rods against rotation.

8. A fuel injection pump according to claim 1 wherein the fuel injection pump comprises a pump rotor providing a distributor rotor and said pump body in coaxial alignment; and a distributor head having a distributor rotor bore and a plurality of distributor outlet ports angularly spaced around the distributor rotor bore; the distributor rotor being rotatably mounted in the distributor rotor bore and having a peripheral distributor port located to register with the distributor outlet ports in sequence for distributing the high pressure charges of fuel; the distributor rotor having a transverse connector bore with a connector inlet port trailing the peripheral distributor port and located for registry with each active distributor outlet port as the distributor port rotates out of registry with said active port and a connector outlet port located for registry with another distributor outlet port as the distributor port moves out of registry with said active port.

9. In a rotary fuel injection pump having a pump rotor providing a pump, body and distributor rotor in coaxial alignment, the pump body having a pumping chamber with a plurality of pumping plunger bores with axes extending radially outwardly from the axis of the pump rotor; a pumping plunger mounted in each plunger bore; a cam ring surrounding the pump body for reciprocating the pumping plungers for supplying intake charges of fuel to the pumping chamber and delivering high pressure charges of fuel from the pumping chamber for fuel injection; and a distributor head having a distributor rotor bore and a plurality of distributor outlet ports angularly spaced around the distributor rotor bore; the distributor rotor being rotatably mounted in the distributor rotor bore and having a peripheral distributor port located to register with the distributor outlet ports in sequence for distributing the high pressure charges of fuel; the improvement wherein the distributor rotor has a transverse connector bore with a connector inlet port trailing the peripheral distributor port and located for registry with each active distributor outlet port as the distributor port rotates out of registry with said active port and a connector outlet port located for registry with another distributor outlet port as the distributor port moves out of registry with said active port.

10. A rotary fuel injection pump according to claim 9 wherein said transverse connector bore in the distributor rotor has a snubber orifice for dampening reflected pressure waves from said active port.

11. A rotary fuel injection pump according to claim 9 wherein the fuel injection pump further comprises a spill mechanism for spilling fuel from the pumping chamber for spill termination of the delivery of the high pressure charges of fuel in fixed synchronism with the pumping plungers before the distributor port rotates out of registry with each active distributor outlet port.

12. In a rotary fuel injection pump having an outer cam ring and inner pump body in coaxial relationship; the pump body having a pumping chamber with at least one diametral pumping plunger bore; a pair of opposed pumping plungers in each diametral pumping plunger bore; the cam ring and pump body being relatively rotatable for periodically actuating the pumping plungers inwardly with the cam ring for delivering high pressure charges of fuel from the pumping chamber for fuel injection; and a spill mechanism for spilling fuel from the pumping chamber for spill termination of the delivery of the high pressure charges of fuel; the spill mechanism comprising a spill valve having a coaxial valve bore in the pump body in communication with the pumping chamber and a spill valve member shiftable in the valve bore in one axial direction to a closed position thereof and in the opposite axial direction to an open position thereof for spilling fuel from the pumping chamber, means biasing the valve member in said one direction to its closed position and a valve actuating mechanism for actuating the valve member in said opposite axial direction to its open position to terminate the high pressure delivery of fuel in fixed synchronism with the inward actuation of the pumping plungers; the improvement wherein the spill valve member has at least one peripheral spill port with a leading spill edge in a transverse plane perpendicular to the axis of the valve member and wherein the spill port moves into communication with the pumping chamber as the spill valve is actuated in said opposite direction from its closed position to its open position.

13. A fuel injection pump according to claim 12 wherein the spill valve member has a diametral slot with opposed, parallel side faces and a flat, diametral end face and wherein the valve actuating mechanism comprises a diametral actuator rod bore in the pump body, a pair of radial actuator rods mounted in the actuator rod bore for inward radial actuation by the cam ring in synchronism with the inward actuation of the pumping plungers, and a self-centering actuator shoe mounted within the diametral slot in operative engagement with said end face, for diametral movement within the diametral slot and for operative engagement by the actuator rods for translating inward radial movement of the actuator rods into axial movement of the valve member in said opposite direction.

14. A fuel injection pump according to claim 13 wherein the actuator shoe and each actuator rod have cooperating cam surfaces for translating inward radial movement of the actuator rods into axial movement of the valve member in said opposite direction.

15. A fuel injection pump according to claim 14 wherein the cooperating cam surfaces lie in planes extending at an angle of approximately 45° to the axes of the valve member and actuator rods.

16. A fuel injection pump according to claim 12 wherein the spill valve member is a spool valve and has at least two of said peripheral spill ports.

17. A fuel injection pump according to claim 16 wherein the spill valve member has a diametral spill bore and wherein the two peripheral spill ports are located at the outer ends of the diametral spill bore.

18. A fuel injection pump according to claim 13 wherein the actuator shoe and the inner ends of the actuator rods have outer parallel side faces engageable with the opposed parallel side faces of the valve member slot to retain the actuator shoe and actuator rods against rotation.

* * * * *

UNITED STATES PATENT AND TRADEMARK OFFICE

CERTIFICATE OF CORRECTION

PATENT NO. : 5,685,275

DATED : November 11, 1997

INVENTOR(S) : Ilija Djordjevic

It is certified that error appears in the above-indentified patent and that said Letters Patent is hereby corrected as shown below:

Column 8, line 39, delete the comma before "body".

Signed and Sealed this

Fifth Day of May, 1998

*Attest:*

*Attesting Officer*

BRUCE LEHMAN

*Commissioner of Patents and Trademarks*